US011857134B2

(12) United States Patent
Kessler et al.

(10) Patent No.: US 11,857,134 B2
(45) Date of Patent: Jan. 2, 2024

(54) RETROFITTABLE SENSOR UNIT FOR CONTROLLING A DOSING DEVICE

(71) Applicant: Henkel AG & Co. KGaA, Duesseldorf (DE)

(72) Inventors: Arnd Kessler, Monheim am Rhein (DE); Christian Nitsch, Duesseldorf (DE); Lars Zuechner, Langenfeld (DE); Georg Wawer, Vienna (AT); Alexander Mueller, Monheim (DE); Clemens Arth, Graz (AT)

(73) Assignee: HENKEL AG & CO. KGAA, Duesseldorf, NY (US)

( * ) Notice: Subject to any disclaimer, the term of this patent is extended or adjusted under 35 U.S.C. 154(b) by 408 days.

(21) Appl. No.: 16/465,479

(22) PCT Filed: Dec. 7, 2017

(86) PCT No.: PCT/EP2017/081850
§ 371 (c)(1),
(2) Date: May 30, 2019

(87) PCT Pub. No.: WO2018/114359
PCT Pub. Date: Jun. 28, 2018

(65) Prior Publication Data

US 2020/0063323 A1 Feb. 27, 2020

(30) Foreign Application Priority Data

Dec. 21, 2016 (DE) ..... 10 2016 225 854.0

(51) Int. Cl.
*D06F 39/02* (2006.01)
*A47L 15/00* (2006.01)
(Continued)

(52) U.S. Cl.
CPC ..... *A47L 15/4297* (2013.01); *A47L 15/0055* (2013.01); *A47L 15/449* (2013.01);
(Continued)

(58) Field of Classification Search
CPC ..... A47L 15/0055; A47L 15/4445; A47L 15/449; A47L 15/4297; A47L 2401/04;
(Continued)

(56) References Cited

U.S. PATENT DOCUMENTS 10,012,971 B2 7/2018 Pietsch et al.
2001/0049846 A1* 12/2001 Guzzi ..... D06F 34/22 68/17 R
(Continued)

FOREIGN PATENT DOCUMENTS

CN 1377431 A 10/2002
CN 101809221 A 8/2010
(Continued)

OTHER PUBLICATIONS

EPO, International Search Report and Written Opinion issued in International Application No. PCT/EP2017/081850, dated Apr. 17, 2018.

*Primary Examiner* — Marc Lorenzi
(74) *Attorney, Agent, or Firm* — Lorenz & Kopf, LLP

(57) ABSTRACT

A retrofittable sensor unit for controlling a dosing device of a cleaning machine includes an acquisition module having at least one sensor for capturing measurement variables, at least one monitoring unit for determining a current degree of soiling of articles for cleaning on the basis of the captured measurement variables, a communication unit configured to communicate with at least one dosing device, in particular to transmit a dosing command to at least one dosing device depending on the current degree of soiling of the articles for
(Continued)

cleaning. The retrofittable sensor unit can be arranged separately from the dosing device.

13 Claims, 6 Drawing Sheets

(51) Int. Cl.

| | |
|---|---|
| ***A47L 15/44*** | (2006.01) |
| ***A47L 15/42*** | (2006.01) |
| ***D06F 33/57*** | (2020.01) |
| ***D06F 34/22*** | (2020.01) |
| *D06F 103/02* | (2020.01) |
| *D06F 103/18* | (2020.01) |
| *D06F 103/20* | (2020.01) |
| *D06F 105/42* | (2020.01) |
| *D06F 105/58* | (2020.01) |

(52) U.S. Cl.
CPC ..... *D06F 33/57* (2020.02); *D06F 34/22* (2020.02); *D06F 2103/02* (2020.02); *D06F 2103/18* (2020.02); *D06F 2103/20* (2020.02); *D06F 2105/42* (2020.02); *D06F 2105/58* (2020.02)

(58) Field of Classification Search
CPC ..... A47L 2401/10; A47L 2401/11; A47L 2401/30; A47L 2501/07; D06F 33/37; D06F 33/57; D06F 34/22; D06F 2103/02; D06F 2103/18; D06F 2103/20; D06F 2105/52; D06F 34/18; D06F 2103/06
See application file for complete search history.

(56) References Cited

U.S. PATENT DOCUMENTS

| | | | | |
|---|---|---|---|---|
| 2003/0106164 | A1* | 6/2003 | Metzger-Groom .... | G01N 33/24 8/158 |
| 2003/0227394 | A1* | 12/2003 | Rothgeb ..... | B08B 3/00 340/870.01 |
| 2012/0247158 | A1* | 10/2012 | Ditze ..... | D06F 39/022 68/17 R |
| 2013/0061889 | A1 | 3/2013 | Bastigkeit et al. | |
| 2013/0145565 | A1* | 6/2013 | Grimminger ..... | D06F 33/46 68/12.02 |
| 2015/0208896 | A1* | 7/2015 | Willey ..... | A47L 15/4236 134/1 |
| 2016/0057512 | A1 | 2/2016 | Metz | |
| 2018/0156725 | A1* | 6/2018 | Kessler ..... | G01N 21/3577 |

FOREIGN PATENT DOCUMENTS

| | | | |
|---|---|---|---|
| CN | 102088893 | A | 6/2011 |
| CN | 103334264 | A | 10/2013 |
| CN | 103334265 | A | 10/2013 |
| DE | 102006043915 | A1 | 3/2008 |
| DE | 102010003770 | A1 | 10/2011 |
| DE | 102012017323 | A1 | 3/2013 |
| DE | 102013218466 | A1 | 3/2014 |
| DE | 102012223615 | A1 | 6/2014 |
| DE | 102013218468 | A1 | 3/2015 |
| DE | 102015107976 | A1 | 11/2016 |
| DE | 102015209824 | A1 | 12/2016 |
| KR | 950012727 | B1 | 10/1995 |
| KR | 20130044764 | A | 5/2013 |
| KR | 20160039872 | A | 4/2016 |
| WO | 0107702 | A1 | 2/2001 |
| WO | 03100153 | A1 | 12/2003 |

* cited by examiner

RETROFITTABLE SENSOR UNIT FOR CONTROLLING A DOSING DEVICE

CROSS-REFERENCE TO RELATED APPLICATIONS

This application is a U.S. National Stage entry under 35 U.S.C. § 371 based on International Application No. PCT/EP2017/081850, filed Dec. 7, 2017, which was published under PCT Article 21(2) and which claims priority to German Application No. 10 2016 225 854.0, filed Dec. 21, 2016, which are all hereby incorporated in their entirely be reference.

TECHNICAL FIELD

The present disclosure relates to a sensor unit for controlling a dosing device of a cleaning machine and a method for measured dispensing of cleaning agents.

BACKGROUND

A known problem when cleaning with the aid of cleaning machines relates to the measured dispensing of the cleaning agent used, in particular regarding the optimum time for releasing the cleaning substance and the optimum quantity. An unsatisfactory washing result is obtained in both cases, if too much and too little of the cleaning agents is dispensed. And in the case of a dose that is too large, unnecessary amounts of energy, cleaning agent and water are used, thereby not only increasing costs but also creating a greater environmental burden.

However, it is not a simple matter to deliver the exact dose of the cleaning agent, since the correct dosage depends not only on the quantity and degree of soiling of the objects that are to be cleaned, but also on other factors, such as the cleaning programme selected, the nature of the soiling, water hardness, the cleaning agent itself and any cleanings additives or the like.

In order to solve the abovementioned problems, cleaning machines with integrated automatic dosing systems are known which rely on various sensors to identify certain operating states of cleaning machines and to release cleaning agents into the cleaning machines in measured quantities depending on the operating states, so that a single cleaning operation preferably includes multiple dosing operations. However, since the average service life of cleaning machines is about 15 to about 20 years, cleaning machines with integrated automatic dosing systems have found their way into only a small number of households. On the other hand, given that there is significant interest in automatic dosing systems, demand is growing for retrofittable systems. With a view to this demand, there is also interest in optimising the dosing of cleaning agents further by controlling the dosing at least not only by the detected operating states of a cleaning machine, but also using other suitable parameters.

SUMMARY

In the context of the related art as described above, it is thus the object of the present disclosure to avoid or at least reduce the problems described to some degree, i.e. to suggest a retrofittable system for automatic dosing of cleaning agents which delivers good cleaning results while consuming little energy, water and cleaning agent.

This object is solved in real terms with a retrofittable sensor unit, a mobile dosing device, and a method for measured dispensing.

It has been found that a cleaning method which is particularly economical in terms of energy, water and cleaning agent can be implemented if the progress of the process for cleaning items to be cleaned is captured continuously, so that a cleaning operation can be ended extremely flexibly when a desired cleaning state is reached or it can be continued with modified conditions.

According to a first aspect of the present disclosure, therefore, a retrofittable sensor unit for controlling a dosing device of a cleaning machine is suggested, comprising: an acquisition module including at least one sensor, configured to capture measurement variables; at least one monitoring unit configured to determine a current soiling state of items for cleaning on the basis of the captured measurement variables; at least one communication unit configured to communicate with at least one dosing device, in particular configured to transmit a dosing command to at least one dosing device depending on the current degree of soiling of the articles to be cleaned; wherein the retrofittable sensor unit may be arranged separately from the dosing device.

For the present purposes, cleaning machines are understood to include in particular domestic appliances such as washing machines, dishwashers, tumble dryers, rotary irons and the like, but cleaning machines may also be understood to refer to industrial kitchen devices or devices in textile cleaning businesses.

It has been found that it is already possible to make a fairly accurate estimate of the degree of soiling of articles for cleaning simply by capturing measurement variables of a washing solution during a cleaning operation, so that with a knowledge of the current degree of soiling of articles for cleaning a dosing command may be transmitted from a retrofittable sensor unit to a dosing device.

It is therefore suggested that according to a preferred embodiment the acquisition module of the retrofittable sensor unit includes at least one sensor for capturing measurement variables or a washing solution, in particular at least one sensor for measuring the viscosity, turbidity, pollen load, water hardness, dye elution, pH-value or odour.

A sensor for capturing measurement variables in a washing solution may be arranged on a housing of a retrofittable sensor unit, preferably in a recess of a housing of a retrofittable sensor unit. In this case, the sensor may preferably be attached to the retrofittable sensor unit by force-fitting or material bonding. The sensor is preferably screwed or glued onto a housing or a recess in the housing of the retrofittable sensor unit. Or alternatively, the sensor may also be integrated in a housing of the retrofittable sensor unit, preferably in a detection channel of a retrofittable sensor unit. The sensor may be part of the retrofittable sensor unit in the state as manufactured, or it may also be part of a retrofittable system.

According to a preferred embodiment, it is suggested that the acquisition module of the retrofittable sensor unit should include at least one mini- or microcamera for capturing measurement variables of an article for cleaning. In particular, the camera may be designed to capture additional information about the condition of the article for cleaning. In the process, the camera may also preferably take pictures of the washing solution and/or the article for cleaning during the cleaning process, which pictures may then be analysed by the monitoring unit of the retrofittable sensor unit using modern image processing algorithms. This is advantageous particularly because the determination of a degree of soiling of articles for cleaning may depend largely on the respective material of the article for cleaning. Some materials are more difficult to clean than others, which is why in this case a corresponding continuation of the cleaning operation would be advisable. Other stains may be very difficult or even impossible to remove from materials that are to be cleaned, so the cleaning operation may be terminated at this point. It may further be advantageous if a retrofittable sensor unit which can be installed in various cleaning machines is able to determine whether the respective article for cleaning is for example the crockery in a dishwasher or dirty textiles in a washing machine.

In order to enable rapid capture and processing of the image material with high light sensitivity, it is suggested that the mini- or microcameras be designed to include a CCD image sensor. A camera with CCD sensor is recommended in particular because of its good sensitivity to light.

Alternatively, particularly in an inexpensive, energy conserving variant, the mini- or microcameras may also be equipped with CMOS image sensors.

Since it is advisable not to use very large image sensors so that little space is taken up by the arrangement, it is suggested to select the resolution of the mini- or microcameras such that they can deliver pictures of the surface structure of the articles for cleaning in sufficiently good resolution, but at the same time still guarantee sufficient sensitivity to light. Therefore, according to a preferred embodiment it is suggested that the mini- or microcameras have a resolution not greater than 8 MP, preferably not greater than 6 MP, in particular not greater than 4 MP.

In order to be able to make a particularly accurate prediction regarding a current degree of soiling of articles for cleaning, it is suggested to combine several analysis methods with each other. Accordingly, for example, a cleaning machine may be filled with different numbers of articles for cleaning, and consequently an output using only one sensor for capturing measurement variables of a washing solution may possibly lead to inconsistent results. In such a case, it would be advisable if, besides the prediction of a current degree of soiling of articles for cleaning through an analysis of the washing solution, for example, an additional determination were also made of the weight of the article for cleaning with an analysis of the rotating behaviour of the washing drum, for example.

Therefore, other sensors besides a sensor for capturing measurement variables of a washing solution, may be arranged on the retrofittable sensor unit and/or the dosing device and/or the cleaning machine which may help to enable a determination of a degree of soiling of articles for cleaning to be made faster and more accurately.

Thus, in addition to a sensor for capturing measurement variables of a washing solution at least one sensor for measuring geometric or mechanical measurement variables may be provided, in particular a sensor for location, distance, position or fill level, a particle size sensor, a pollen load sensor, a layer thickness sensor, a light scanner, a force, mass, pressure or viscosity sensor, a surface tension or turning moment sensor.

Equally, in addition to a sensor for capturing measurement variables of a washing solution at least one sensor may be provided for measuring dynamic, thermal or calorific measurement variables, in particular a time, wavelength, speed or rotating speed sensor, a temperature, thermal conductivity or heat flow sensor; a moisture sensor, a particle density sensor; a photon counter, a Fibre optic sensor or a colour value sensor.

Further, besides a sensor for capturing measurement variables of a washing solution at least one sensor may be provided for measuring the following measurement variables: climatic measurement variables; optical or acoustic measurement variables; electrical measurement variables; chemical, biological or medical measurement variables.

In particular, besides a sensor for capturing measurement variables of a washing solution, one of the following sensor types may be provided: turbidity sensor, refraction index sensor, spectral distribution sensor, infrared sensor, UV sensor, contrast sensor; sound, structure-borne sound or ultrasound sensor, loudness sensor; voltage, capacitance or field strength sensor, magnetic flux density sensor or inductance sensor; electrochemical sensor, pH-value sensor, ion-selective sensor, in particular a water hardness sensor, odour sensor or dye elution sensor.

According to an advantageous embodiment it is suggested that the retrofittable sensor unit include a monitoring unit, which determines a current degree of soiling of articles for cleaning and is able to send a dosing command to a mobile dosing device based on the determined degree of soiling or make other settings and configurations of mobile dosing device.

In this context, the monitoring unit preferably has access to all measurement variables captured by the various sensors and cameras of the acquisition module, with the aid of which the monitoring unit is able to determine a current degree of soiling of the article for cleaning.

For this purpose, the monitoring unit of the retrofittable sensor unit may preferably access a database in which values for different measurement variables are stored, in particular depending on a certain machine type. These may be for example viscosity values for different machine types depending on the temperature, the cleaning agent added and the like. Surface profiles of a wide range of materials may also be stored in the database, so that the monitoring unit is able to identify the material of an articles for cleaning by comparing the images captured by the mini- or microcamera.

The monitoring unit of the retrofittable sensor unit preferably sends commands to the mobile dosing device depending on the determined current degree of soiling of articles for cleaning.

In this context, the retrofittable sensor unit and the mobile dosing device are advantageously in contact with each other wirelessly. According to a preferred variant of the retrofittable sensor unit, the communication unit of the retrofittable sensor unit is embodied as a wireless communication unit, configured for wireless communication, in particular via WLAN, Bluetooth, Zigbee, NFC, Wibree, WiMAX, Measurable Networks, IrDA or optical directional radio. This in particular favours an arrangement of the retrofittable sensor unit separately from the dosing device. Thus the retrofittable sensor unit may advantageously be arranged inside the cleaning machine, and the dosing device may be arranged separately from the sensor unit, for example in the dispenser drawer of a cleaning machine, leaving more space for articles to be cleaned than when the retrofittable sensor unit and the mobile dosing device are arranged together inside the machine.

According to an advantageous embodiment, the retrofittable sensor unit is arranged on the back of the washing drum of a washing machine—preferably in the middle above the washing drum rotation shaft—so that when the washing machine is running the sensor unit rotates around the axis of rotation of the drum. The retrofittable sensor unit is advantageously attached permanently to the back of the washing drum, in particular by force-fitting or material bonding. For example, the retrofittable sensor unit may be screwed or bonded adhesively to the rear wall of the washing drum. Also for fastening the retrofittable sensor unit, a mounting unit may also be provided, which is fastened securely to the drum of a washing machine and in which the retrofittable sensor unit may be installed. In order to minimise friction losses between the sensor housing and a load of washing when a retrofittable sensor unit is arranged on the back of the washing drum of a washing machine, at least a part of the sensor unit is preferably substantially conical or hemispherical in shape. Of course, the sensor unit may equally well be shaped differently, in particular it may be cuboid, cylindrical, prismatic or pyramidal.

According to a further advantageous design, it is suggested that at least part of the retrofittable sensor unit is constructed as a substantially flat part, in particular as a foil, wherein the foil may contain an enormous variety of electrical circuits and electronic components, such as the monitoring unit, the communication unit and energy store. The foil preferably has a diameter of a few centimetres, more preferably about one centimetre, and a layer thickness of a few millimetres, in particular about one millimetre. Because of its flat form, the sensor unit may advantageously be attached, preferably bonded adhesively, to the inner side of the door of a washing machine or dishwasher, thus freeing up valuable space for the articles for cleaning.

According to another advantageous design, it is suggested that the retrofittable sensor unit may be arranged in the outflow from a cleaning machine. In this case, the sensor unit preferably includes sensors spread through the outflow of the cleaning machine for capturing a condition of a washing solution, in particular viscosity sensors, turbidity sensors and water hardness sensors. From the determination of the condition of the washing solution it is then possible to draw a conclusion about the current degree of soiling of the article for cleaning, so that a measured quantity of cleaning agent can be dispensed in controlled manner.

In addition, the retrofittable sensor unit may also be arranged in the metering chamber of a dishwasher or the detergent compartment of a washing machine, thereby also saving space for the articles to be cleaned.

As well as the capability for wireless communication with the dosing device, the wireless communication unit also offers the capability of wireless communication between the retrofittable sensor unit and other cleaning machines in a private or public network. Communication is preferably also controlled by the monitoring unit of the retrofittable sensor unit. Communication among different cleaning machines is particularly advantageous when various cleaning steps are to be combined with each other. For example, a tumble dryer or a rotary iron might receive information about the nature of the laundry that is to be dried and/or ironed next via the retrofittable sensor unit even before a washing cycle is complete, so that the optimum settings and other preparations can be made for the corresponding operation in advance.

According to an advantageous embodiment, it is suggested that the monitoring unit of the retrofittable sensor unit also be configured for wireless communication with a portable user terminal via the communication unit. This enables the user to track cleaning operations within a private or public network via the user terminal, for example. A user may preferably also be able to intervene in a cleaning operation via the user terminal and make changes and configurations on the retrofittable sensor unit via the user terminal. In this context, a mobile user terminal may be a smartphone, a smartwatch, a smartcam, a tablet, a PC, a home automation system or the like, and may preferably communicate with the retrofittable sensor unit via WLAN or Bluetooth, or also via a GSM, GPRS, Edge, UMTS, 3G, LTE or 4G link put in place by a mobile phone operator.

When the current degree of soiling of the articles for cleaning is known, the ability to intervene in a cleaning operation makes it possible to vary the duration of a cleaning programme. Thus for example a user can cancel a cleaning operation if the cleaning condition already meets his requirements. This is not possible with conventional cleaning methods, in which it must be determined in advance how long a cleaning operation should last. Accordingly, the capability of cancelling a cleaning operation may also help to conserve large quantities not only of cleaning agent but also of water and energy, which lowers costs and also reduces the burden on the environment. Similarly, if it is known that the cleaning result is unsatisfactory the duration of the cleaning operation may be prolonged by variable time increments. This too promises opportunities for savings if the alternative were to repeat the entire cleaning operation.

According to a preferred variant, the retrofittable sensor unit and in particular the monitoring unit of the sensor unit may transmit the current degree of soiling of the article for cleaning and/or the cleaning progress and error messages as well as other information to a user terminal, so a user can track the progress of the cleaning operation via the user terminal.

In order to ensure the necessary supply of power to the retrofittable sensor unit, it is suggested that the retrofittable sensor unit have an autarchic energy conversion system, preferably in the form of a vibratory gyroscope or dynamo to generate electrical energy from rotational energy. Alternatively, another energy conversion system may also be connected to the retrofittable sensor unit to convert other forms of energy into electrical energy. It is further suggested that alternatively or in addition to an autarchic energy conversion system a mobile energy supply unit be arranged on the retrofittable sensor unit, particularly in the form of batteries or rechargeable batteries to guarantee the supply of electrical energy to the retrofittable sensor unit at all times.

Alternatively, the retrofittable sensor unit may also include a device for inductive and contactless transmission of electrical energy, so that the retrofittable sensor unit can be supplied with electrical power either contactlessly by induction or it can supply electrical power to the dosing device for example. Therefore, it is suggested that the retrofittable sensor unit have at least one coil for generating a magnetic field and/or an electrical field.

In order to be able to store the configurations and settings for the cleaning processes and the captured soiling states of the washing solution or the article for cleaning as well as communication protocols and the like, according to a further preferred design it is suggested that the retrofittable sensor unit have a memory unit. Alternatively or in addition to a memory unit integrated in the retrofittable sensor unit, the memory unit may also be embodied as a remote server. Storage on an external server is advisable particularly if a large quantity of user data is to be stored continuously and the memory unit should not take up too much room. In order to assure failsafe data storage in spite of this, preferably only a small local memory arranged on the retrofittable sensor unit may be provided, which is purged continuously after the data has been transmitted to the server.

According to a another preferred design, it is suggested that the monitoring unit of the retrofittable sensor unit be embodied as a self-learning unit, which is able to record the habits of the users over time, such as the times when cleaning operations are carried out, and/or personal preferences and particularities to deduce further information therefrom regarding cleaning activities that are to be expected in future. The monitoring unit is preferably able to access the user profiles and initiate actions on the basis of the user profiles. For example, the monitoring unit may have access to the data stored in a server in a cloud via a router of a private or public network.

Advantageously, the user is able to check the function of the monitoring unit. In a first configuration, a user is preferably able to make a first setting of parameter, such as access data and encryptions for external services or running services.

According to this configuration, when enabled by a user the monitoring unit can communicate with other services in a cloud on the available communication channels via a preferably secured connection. Then, an exchange of data may take place in the cloud preferably via a DSL or VDSL router or alternatively via a LTE and 3G router, which is preferably also compatible with UMTS and HSDPAMSUPA networks.

The monitoring unit may advantageously store, provide and share information in the cloud and also transfer this information to certain services, users and other entities and processing units for further processing. The monitoring unit is preferably also able to display the information and make it available for statistical purposes, for example. In particular, in this way the monitoring unit may be enabled to initiate ordering of consumables or spare parts, and possibly even arrange maintenance appointments via the cloud. And the monitoring unit can also request and receive automatic updates of the software for individual components via the same path. Moreover, the monitoring unit may also be able to send messages about an initiated action to one or more operators of the device via the cloud, by email, SMS for example, or by initiating a call by a service running in the cloud.

Additionally, the monitoring unit may preferably also have the access data to for the operator's accounts with online providers of consumables, so that a direct connection to a provider and automatic reordering of consumables may be initiated using the access data to the respective account. For this purpose, the monitoring unit may also have personal data of an operator, such as email address and phone number for contacting the operator directly.

It is further suggested that the monitoring unit advantageously also has the necessary interfaces and prerequisites for receiving and processing tracking and control commands from the cloud via the available communication channels and the preferably secured connection with the cloud, so that in particular control of a cleaning machine may be exercised via a service running in the cloud. Moreover, control parameters may also be changed via a service running in the cloud to start an operation, or also to cancel an operation which is running or scheduled.

Further according to a first aspect of the present disclosure, a mobile dosing device is suggested for the measured dispensing of cleaning agents in cleaning machines, comprising: at least one metering chamber; at least one feed unit; at least one communication unit, configured for communication with at least one retrofittable sensor unit which can be arranged separately from the dosing device, in particular configured to receive a dosing command from the retrofittable sensor unit depending on a degree of soiling of articles for cleaning determined by the retrofittable sensor unit; wherein the dosing device is configured such that a metered supply of cleaning agent to the cleaning machine takes place on the basis of the communication with the retrofittable sensor unit.

The actual dosing device may be part of a cleaning machine as manufactured, or also part of a retrofittable system. The dosing device is preferably disposed in the detergent compartment of a washing machine or the metering chamber of a dishwasher, and constructed with corresponding resistance to the cleaning agents and other mechanical and chemical factors to which it is exposed during the respective cleaning operations. In a washing machine, a dosing device may also be arranged in the washing drum, for example. In a dishwasher, the dosing device may preferably be located in the cutlery basket or the crockery trays.

For the specific purposes of the present, cleaning agents are understood to include not only deter detergents, but in particular also fabric softeners, machine cleaners, dishwashing agents, water softeners, rinsing agents, starch, vinegar-based cleaners, water repellents, colour protection agents, bleaches, greying inhibitors and bioactive systems and the like.

The cleaning agent may be present in a metering chamber for example in solid, liquid, and/or gaseous. The cleaning agent is for example a pure substance and/or a mixture of substances. A solid cleaning agent may have the form for example of a powder, a tablet and/or a tab which can be dispensed in measured amounts. A liquid cleaning agent may be dispensed for example as a gel, as concentrated and/or diluted solution. Of course, the cleaning agent may also be dispensed as a foam, as hard foam, as emulsion, as suspension and/or as aerosol. Examples of cleaning agents and/or their ingredients include but at not limited to one or more components from a group of components comprising tensides, alkalis, builders, greying inhibitors, optical brighteners, enzymes, bleaches, soil-release polymers, fillers, fabric softeners, fragrances, dyes, care substances, acids, starch, isomalt, sugar, cellulose, cellulose derivatives, carboxymethyl cellulose, polyetherimide, silicone derivatives and/or polymethylimine. An exemplary list of other components includes but is not limited to bleach activators, chelating agents, structural materials, electrolytes, non-aqueous solvents pH adjusters, perfume carriers, fluorescing agents, hydrotropes, silicone oils, bentonite, anti-redeposition agents, anti-shrink agents, anti-creasing agents, dye transfer inhibitors, antimicrobial agents, germicides, fungicides, antioxidants, preservatives, corrosion inhibitors, antistatic agents, buttering agents, ironing aids, soil repellents or impregnating agents, anti-swelling or anti-slip substances and/or UV absorbers. A further exemplary list of components includes but is not limited to one or preferably more substances from the group of builders, polymers, bleaches, bleach activators, bleach catalysts, enzymes, thickeners, sequestering agents, electrolytes, corrosion inhibitors, glass corrosion inhibitors, anti-foaming agents, dyes, additives for improving outflow and drying behaviour, disintegration aids, preservatives, pH-adjusting agents, fragrances and perfume carriers.

The use of builders such as silicates, aluminium silicates (particularly zeolites), salts of organic di- and polycarboxylic acids and mixtures of these substances, preferably water-soluble builder substances, may be advantageous.

In a preferred variant as contemplated herein, the use of phosphates (and polyphosphates) is largely or completely avoided. In this variant, the substance comprises less than 5% by weight, particularly preferably less than 3% by weight, in particular less than 1% by weight phosphate(s). In this variant, the substance is most particularly preferably entirely free of phosphates, i.e. the substances comprise less than 0.1% by weight phosphate(s).

The builders include in particular carbonates, citrates, phosphonates, organic structural agents and silicates. The proportion by weight of the structural agents in the overall weight of substances as contemplated herein is preferably from about 15 to about 80% by weight and in particular from about 20 to about 70% by weight.

Preferred cleaning agents, in particular crockery rinsing agents, more preferably crockery rinsing agents for use in machines, are exemplified by a structural combination of citrate and carbonate and/or bicarbonate.

Anionic, non-ionic, cationic and amphoteric tensides are suitable for use as tensides. Tensides are selected according to the intended purpose of the composition.

Suitable anionic tensides are in particular soaps, particularly those which include sulfate or sulfonate groups. Tensides of the sulfonate type are $C_9$-$C_13$-alkylbenzene sulfonates, olefin sulfonates, that is to say mixtures of alkene and hydroxyalkane sulfonates and disulfonates, such as those obtained for example from C12-C18 monoolefins with terminal or internal double bond by sulfonating with gas-phase sulfur trioxide and subsequent alkaline or acidic hydrolysis of the products of sulfonation are preferred candidates. Alkane sulfonates obtained from $C_{12}$-$C_{18}$-alkanes for example by sulfochlorination or sulfoxidation with subsequent hydrolysis or neutralisation are also suitable. The esters of α-sulfofatty acids (ester sulfonates), for example the α-sulfonated methylesters of hydrogenated coconut, palm nut or tallow fatty acids produced by α-sulfonation of the methylesters of vegetable- or animal-based fatty acids having from 8 to 20 C atoms in the fatty acid molecule followed by neutralisation to form water-soluble monosalts are eligible.

Suitable nonionic tensides are in particular alkyl glycosides and ethoxylation and/or propoxylation products of alkyl glycosides or of linear or branched alcohols, each having from 12 to 18 C atoms in the alkyl part and from 3 to 20, preferably from 4 to 10 alkylether groups. Corresponding ethoxylation and/or propoxylation products of N-alkyl-amines, vicinal diols, fatty acid esters and fatty acid amides which correspond to the long-chain alcohol derivatives in respect of the alkyl part, and of alkylphenols having from 5 to 12 C atoms in the alkyl radical are also usable.

Examples of cationic tensides are quaternary ammonium compounds and esterquats, in particular quaternised fatty acid trialkanol amine ester salts.

Typical examples of amphoteric or zwitterionic tensides are alkyl betaine, alkyl amidobetaine, aminopropionates, aminoglycinates, imidazolinium betaine and sulfobetaine.

For optimum measured dispensing, it is suggested that the mobile dosing device preferably include a plurality of metering chambers, which are realised in particular as structural units. In order to be able to achieve particularly efficient cleaning, it is suggested that a dosing device preferably have multiple metering chambers. The metering chambers may be filled with the desired cleaning agent before a cleaning operation preferably via separate refill openings. The refill openings are preferably large enough not only to allow simple refilling, but also to enable a possible rinsing operation to be carried out. Since the dosing devices can be cleaned easily, the same metering chamber can be filled with different cleaning agents after rinsing. In particular, this enables one dosing device to be used in various cleaning machines.

In order to guarantee optimal measured dispensing, it is suggested that the dosing device, in particular the feed unit of a dosing device be equipped with at least one electrical valve and the associated control electronics. The dosing device preferably has a dosing valve for each metering chamber. In this context, the valves are in particular electrically controlled valves. Alternatively, the valves may also be controlled pneumatically or magnetically.

For the necessary energy supply, it is suggested that the mobile dosing device also be equipped with an autarchic energy conversion system. Alternatively, another energy conversion system may be arranged on the mobile dosing device, which converts for example kinetic energy or thermal energy into electrical energy. It is further suggested that alternatively or in addition to an autarchic energy conversion system a mobile energy supply unit be arranged on the mobile dosing device, in particular in the form of batteries or rechargeable batteries in order to guarantee the supply of electrical energy to the mobile dosing device at all times.

Alternatively, the mobile dosing device may also include a device for inductive and contactless transfer of electrical energy, so that the mobile dosing device can be supplied with electrical power contactlessly by induction, or can supply electrical power to the retrofittable sensor unit, for example. Therefore, it is suggested that the dosing device have at least one coil for generating a magnetic field and/or an electrical field.

In order to be able to determine the respective fill levels of cleaning agent in preferably each metering chamber, it is suggested that the mobile dosing device have a measuring device preferably in each metering chamber for measuring a fill level, in particular an absolute fill level. In order to obtain a continuous overview of the cleaning agent fill levels, measurement of the fill level may preferably be performed on a continuous basis, in particular by a mechanical, capacitive or optical measuring method. Alternatively, a fill level measurement may also be performed using a conductivity, ultrasound or microwave method.

In an energy-conserving alternative for continuous measurement of fill levels, the fill levels of the respective metering chambers may also be determined at certain intervals or not until certain limits are determined by fill level limit switches.

In order to be able to display the measured cleaning agent fill levels and optionally to be able to provide a warning to the monitoring unit of the retrofittable sensor unit when low fill levels are reached, it is suggested that the dosing device, in particular the communication unit of the dosing device be designed not only to receive a dosing command from the retrofittable sensor unit, but also that it be able itself to send a message regarding current fill levels to the retrofittable sensor unit.

According to a second aspect of the present disclosure, a method for measured dispensing of cleaning agents in cleaning machines is suggested, comprising the steps of: Capturing at least one measurement variable by a retrofittable sensor unit; Determining a degree of soiling of articles for cleaning on the basis of the at least one captured measurement variable by a retrofittable sensor unit; Communicating between the retrofittable sensor unit and a mobile dosing unit in such manner that a metered quantity of cleaning agent is dispensed to the cleaning machine depending on the communication between the retrofittable sensor unit and the mobile dosing unit.

The communication between a retrofittable sensor unit and a mobile dosing device on the basis of a degree of soiling of articles for cleaning determined by the retrofittable sensor unit may result in no cleaning agent being supplied, for example if a cleaning state of the articles for cleaning is attained which is determined to be satisfactory.

According to a further variant of the method for measured dispensing of cleaning agents in cleaning machines, it is suggested that the method also comprise the following steps: Capturing a fill level of at least one cleaning agent in a dosing device, processing the at least one captured fill level; Communicating between the dosing device and a monitoring unit of the retrofittable sensor unit according to the processing of the captured fill level, so that it is able to implement plans for reordering or refilling tasks.

Based on the cleaning agent fill levels determined by the dosing device, warnings may preferably be transmitted to a mobile user terminal to the effect that a cleaning agent will soon run out.

Besides current fill levels, the dosing device may preferably also forward information about any errors in a rinsing or washing chamber, such as coked contacts, jammed valves or depleted batteries.

According to a further variant, a computer program is also described which comprises software instructions that command a processor to execute and/or control a specific method if the computer program is running on the processor.

In addition, an exemplary computer-readable storage medium comprising an exemplary computer program is described.

According to a third aspect, an exemplary system is also described comprising the retrofittable sensor unit and the mobile dosing device which are configured together to carry out an exemplary method of the type under discussion.

According to a further variant of the system it is suggested that the retrofittable sensor unit and the mobile dosing device be combined in one structural unit. In this way, the retrofittable sensor unit can then also communicate with the mobile dosing device via a cable connection.

The structural unit may be placed for example in the detergent compartment of a washing machine in the form of a retrofittable measuring and dosing system. In the case of a cleaning machine in the form of a dishwasher, the system may also be arranged in a basket in the dishwasher.

The exemplary variants of the present disclosure described previously in this document are also to be considered disclosed in all combinations with each other. In particular, exemplary variants relating to the various aspects are to be considered disclosed.

In particular, corresponding features for performing the process steps by preferred variants of a device are also to be considered disclosed by the preceding or following descriptions of method steps according to preferred variants of a method. Equally, the corresponding method step is also to be considered disclosed by the disclosure of features of a device for performing a method step.

Further advantageous exemplary designs of the present disclosure may be discerned from the following detailed description of several exemplary variants of the present disclosure, particularly in conjunction with the figures. However, the figures are intended solely for illustrative purposes, not to define the scope of protection of the present disclosure. The figures are not true to scale and are intended solely to represent the general concept of the present disclosure for exemplary purposes. In particular, features contained in the figures are in no way to be considered essential components of the present disclosure.

BRIEF DESCRIPTION OF THE DRAWINGS

The present disclosure will hereinafter be described in conjunction with the following drawing figures, wherein like numerals denote like elements, and wherein:

FIG. 7*b* shows a plan view of the retrofittable sensor unit of FIG. 7*a.

DETAILED DESCRIPTION

The following detailed description is merely exemplary in nature and is not intended to limit the disclosure or the application and uses of the subject matter as described herein. Furthermore, there is no intention to be bound by any theory presented in the preceding background or the following detailed description.

Figure 1A:
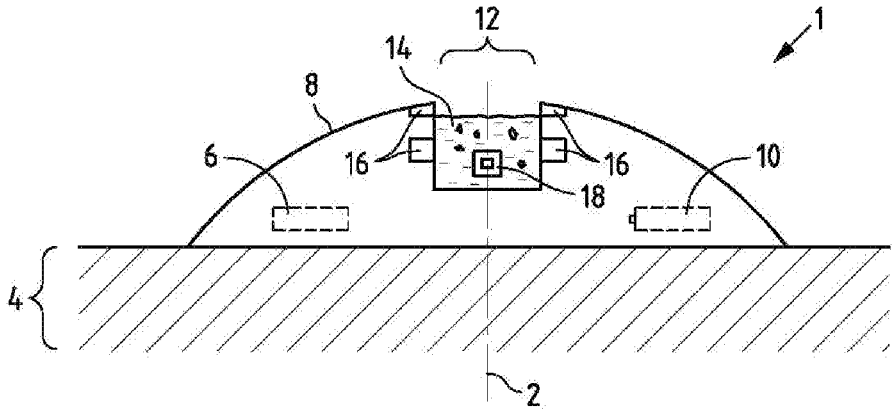
FIG. 1*a* shows a cross-sectional representation of a retrofittable sensor unit according to a first design arranged on the back of the washing drum of a washing machine.

FIG. la shows an exemplary assembly of a retrofittable sensor unit 1 which is arranged on the back of the washing drum 4 of a washing machine 44—preferably in the middle above the rotation shaft of the washing drum 4—and rotates about the axis of rotation 2 of the drum 4 when the washing machine 44 is in operation. In order to minimise friction losses between the sensor housing 8 and the laundry load, the sensor unit 1 is for example conical or hemispherical. According to FIG. 1*a,* a detection area 12 is conformed as in the housing 8 of the retrofittable sensor unit 1 in form of a recess. The detection area 12 accommodates microcameras 16 and—in this example—a viscosity sensor 18 for capturing the condition of a washing solution. With the aid of the microcameras 16 and the viscosity sensor 18, the captured condition of the washing solution may be used to determine a current degree of soiling of the article for cleaning. A dosing command may be transmitted via the communication unit 6 to a dosing device 3 arranged for example in a detergent compartment 30 of the washing machine 44 on the basis of the determined degree of soiling of the article for cleaning. Batteries or rechargeable batteries 10 may be provided to supply energy to the retrofittable sensor unit 1. Alternatively, the retrofittable sensor unit may also be supplied with electrical energy by an energy conversion unit—not shown here. A suitable energy conversion unit may be for example a vibratory gyroscope or dynamo for generating electrical energy from rotational energy. Besides the viscosity sensor 18, a turbidity sensor 18' is also arranged to enable the condition of a washing solution to be captured more accurately, but in the representation of FIG. 1*a* is concealed by the viscosity sensor 18. Of course, other sensors for capturing a condition of a washing solution apart from a viscosity sensor 18 and a turbidity sensor 18' may also be arranged there. Equally, other supporting sensors which do not capture the condition of a washing solution but measure other variables, and which help to determine a degree of soiling of articles for cleaning more quickly and/or more accurately may be arranged on the retrofittable sensor unit 1. The various sensors, in particular the viscosity and turbidity sensors 18, 18' and the optical sensors in the form of microcameras 16 are positioned in the recess in such manner that the washing solution flows around them. Alternatively, the recesses may also be realised as channels which extend from one side to the other of the sensor housing 8. The retrofittable sensor unit 1 is advantageously attached permanently to the back of the washing drum 4, in particular by force-fitting or material bonding. The retrofittable sensor unit 1 may be attached to the rear wall of the washing drum 4 by screwing a adhesive bonding. Or mounting unit—not shown here—which is attached securely t the drum 4 of a washing machine 44 and into which a retrofittable sensor unit 1 may be inserted may also be provided for fastening the retrofittable sensor unit 1.

Figure 1B:
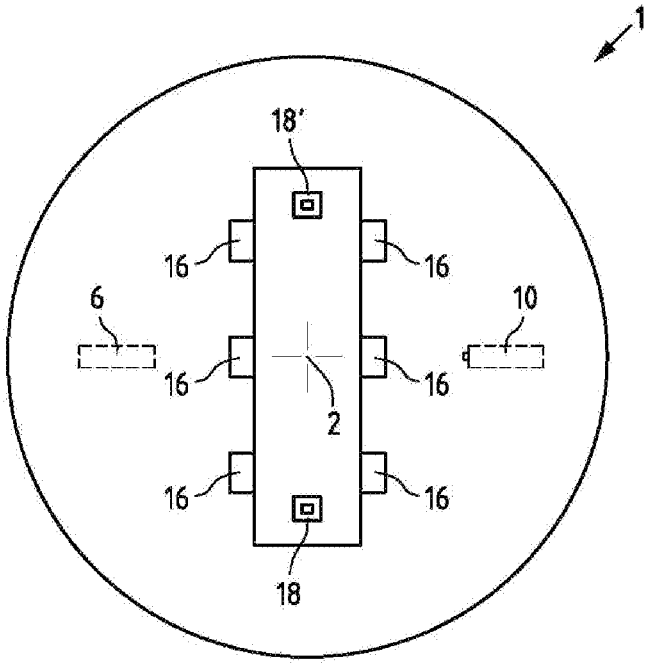
FIG. 1*b* shows a plan view of the retrofittable sensor unit of FIG. 1*a;*

FIG. 1*b* shows a plan view of a retrofittable sensor unit 1 as represented in FIG. 1*a*. Here, the turbidity sensor 18' obscured by the viscosity sensor 18 in the representation according to FIG. la is visible as well as the viscosity sensor.

Figure 2:
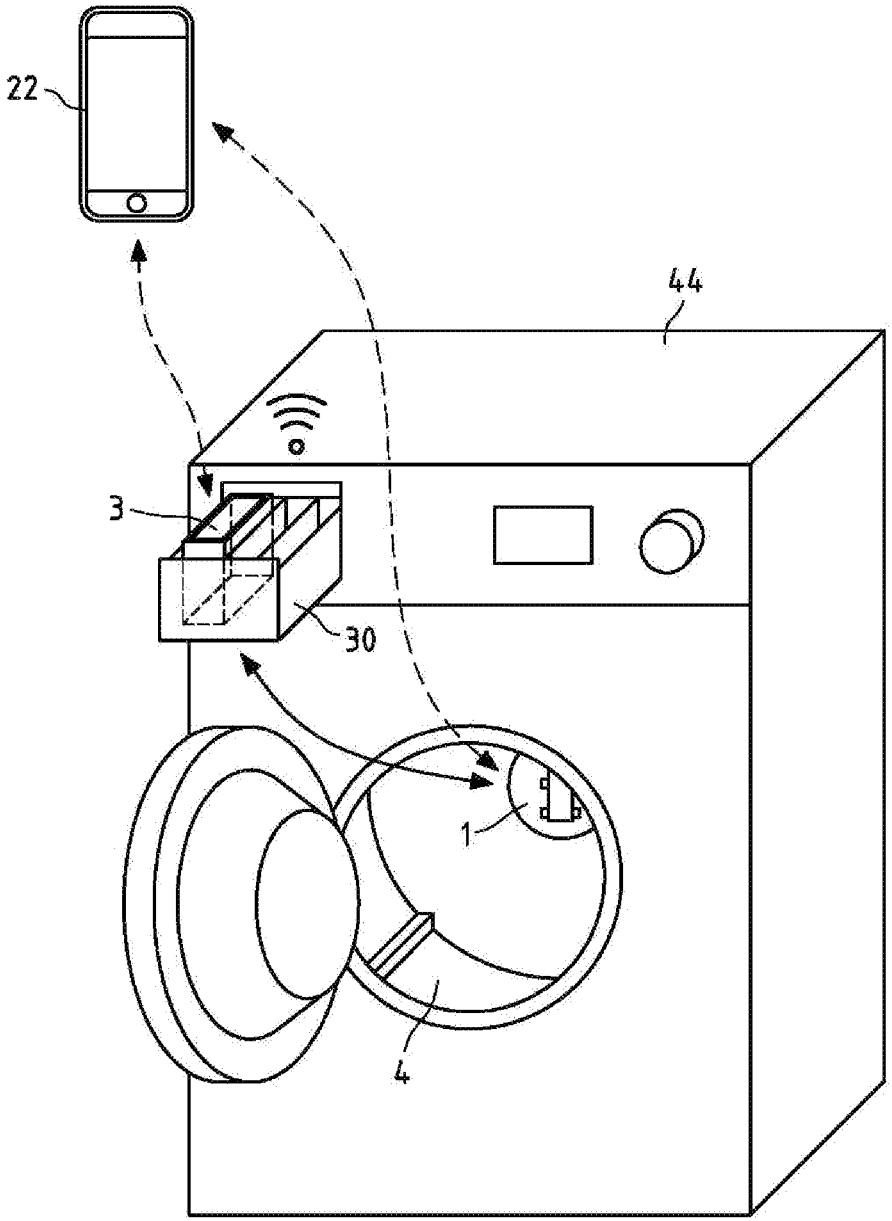
FIG. 2 shows a retrofittable measuring and dosing system with separately located dosing device and sensor unit arranged in a washing machine.

FIG. 2 shows an exemplary assembly of a retrofittable measuring and dosing system with separately arranged dosing device 3 and a measuring unit embodied as sensor unit 1. According to FIG. 2, the mobile dosing device 3 is located in the detergent compartment 30 of the washing machine 44, whereas the retrofittable sensor unit 1 of FIG. 1*a* is arranged in the drum 4 of the washing machine 44. The dosing device 3 and the sensor unit 1 preferably communicate wirelessly via WLAN or Bluetooth with each other and if necessary also with a user terminal 22 such as a user's smartphone or tablet.

Figure 3:
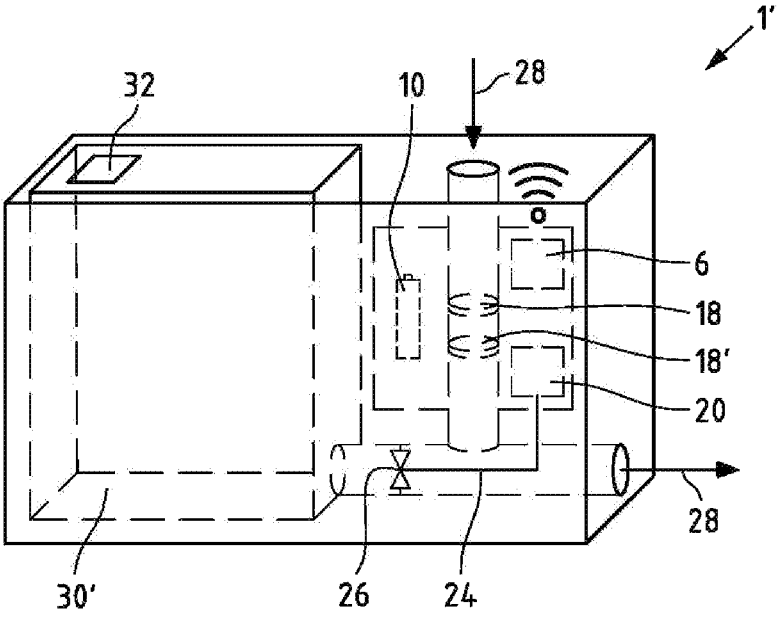
FIG. 3 shows a retrofittable measuring and dosing system as a single combined unit for placement in a detergent compartment of a washing machine.

FIG. 3 shows an exemplary assembly of a retrofittable measuring and dosing system as a single, combined unit 1' for placement in the detergent compartment 30 of a washing machine 44. The dosing device 3 arranged on the left side has a cleaning agent chamber 30' and a refilling opening 32 for filling the cleaning agent chamber 30' with cleaning agent. The dosing device 3 is connected to the water line 28 via the electric valve 26 to enable cleaning agent to be supplied through valve 26 in electronically controlled manner. Control is assured in this case via the monitoring unit 20 of the sensor unit 1, which is connected to the electric valve 26 via a control cable 24. The water for the washing machine 44 which flows into the water line 28 from the top during a washing cycle may be analysed by the viscosity and turbidity sensors 18, 18' arranged in the water line 28, enabling a conclusion to be drawn about the current degree of soiling of the articles for cleaning placed in the washing drum. The retrofittable sensor unit 1 is further equipped with an autonomous power supply in the form of batteries or rechargeable batteries 10 and a communication unit 6 which is configured for wireless communication with any other sensors or a user's user terminal 22, such as a smartphone or a tablet via Bluetooth or WLAN. Of course, the configuration of a retrofittable measuring and dosing system may be realised variously in terms of dimensions and shape depending on the type of the cleaning machine 44. For example, the dosing device 3 may also include multiple chambers 30' which have individual refill openings 32 and are connected to the water line 28 via individual feed devices and electrical valves 26. In this case, the individual valves 26 are advantageously connected to the monitoring unit 20 via individual control cables 24, thereby enabling separate measured dispensing of different cleaning agents depending on the determined degree of soiling of the article for cleaning, controlled by the retrofittable sensor unit 1.

Figure 4:
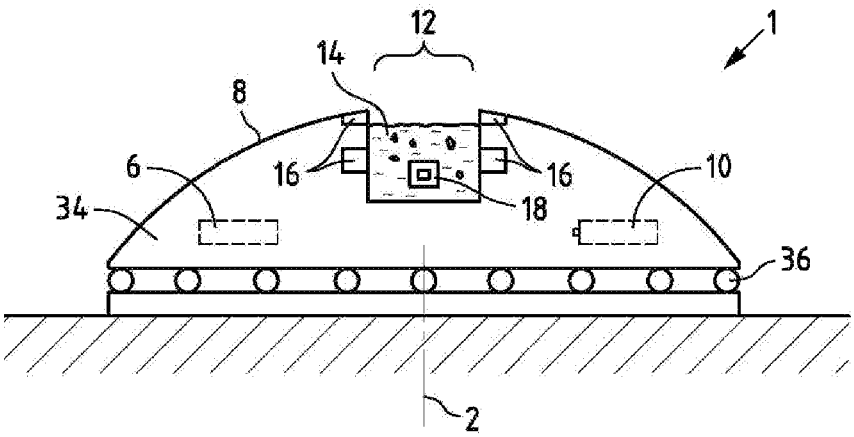
FIG. 4 shows a cross-section through a retrofittable sensor unit in a ball bearing mounted variant.

FIG. 4 shows ball bearing mounted variant of a retrofittable sensor unit 1, in which the sensor unit 1 does not rotate with the drum 4 of a washing machine 44. In this variant, the sensor unit 1 is connected to a mounting 34 that is attached to the rear side—centrally above the rotation shaft of the washing drum 4—so that the sensor unit 1 is able to compensate for the rotation of the drum 4 by the ball bearing 36 and remains in the prescribed position and orientation even while the drum rotates.

Figure 5:
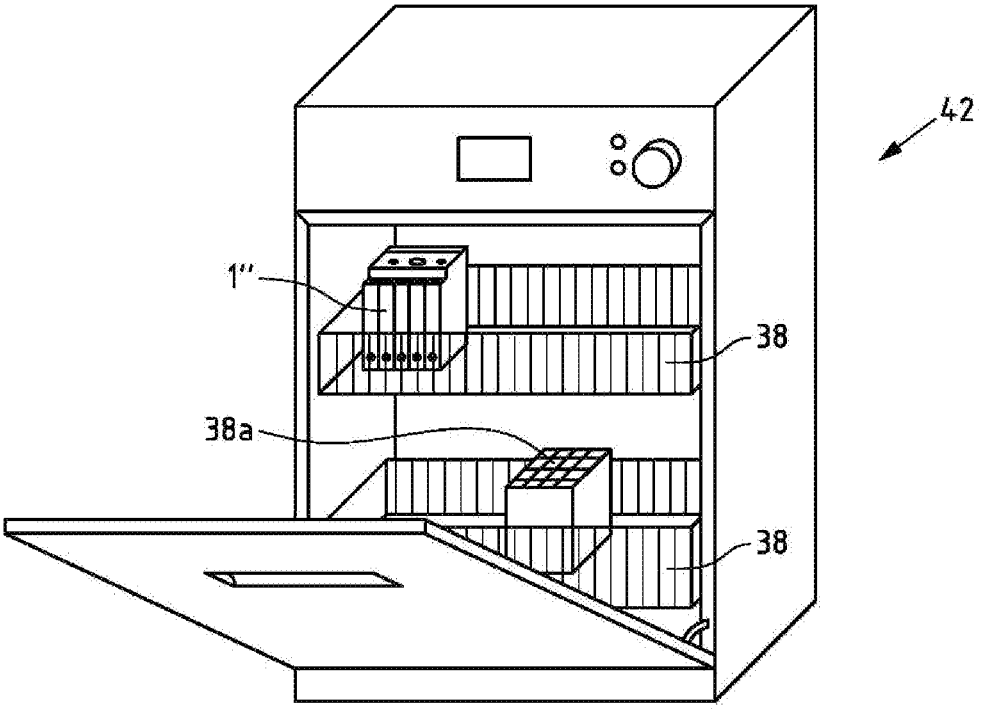
FIG. 5 shows a module comprising a combination of retrofittable sensor unit and dosing device embodied as a single unit, arranged in one of the baskets of a dishwasher.

FIG. 5 shows a system 1" designed as a unit combining a retrofittable sensor unit 1 and dosing device 3, arranged in one of the baskets 38 of a dishwasher 42. In this variant, it is advantageous if the retrofittable sensor unit 1 and the dosing device 3 are connected to each other electrically by direct wiring. The system 1" is preferably equipped with an integrated autarchic power supply and may alternatively also be arranged in the cutlery basket 38*a* of the dishwasher 42.

Figure 6:
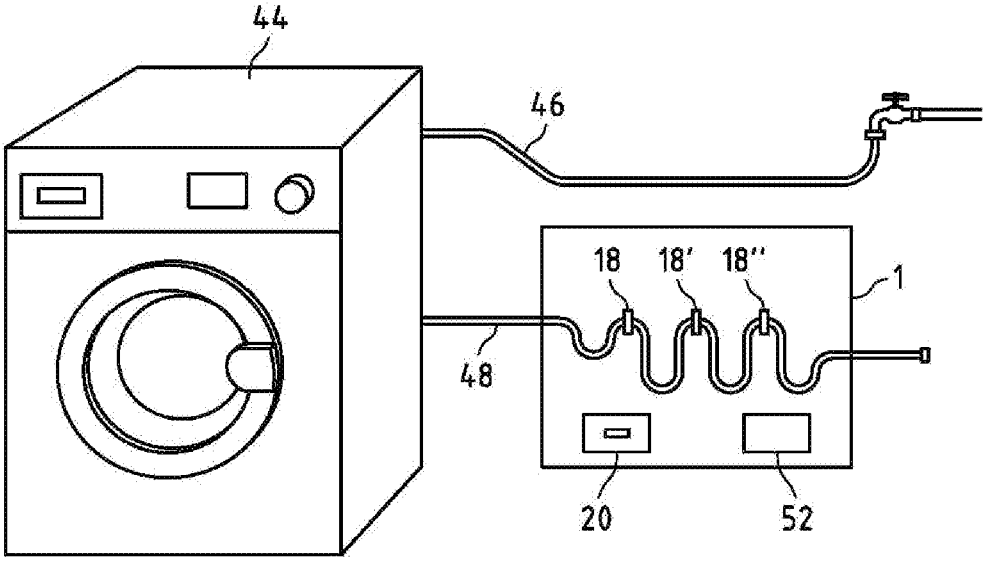
FIG. 6 shows a retrofittable sensor unit integrated in the outflow of a cleaning machine.

FIG. 6 shows an implementation of the retrofittable sensor unit 1 in which the sensor unit 1 is installed in the outflow 48 of a washing machine 44. This includes the integration of an immense variety of sensors at various locations in the outflow 48 for example for measuring viscosity, turbidity and the hardness of the water as it is pumped out, so that conclusions may be reached about the current degree of soiling of the articles for cleaning. These sensors are connected to the monitoring unit 20, which initiates further measured dispensing with commands to the retrofittable dosing unit 3, which may be arranged in the detergent compartment 30 of the washing machine 44 for example. In this context, the communication unit establishes a wireless connection with the dosing unit via WLAN or Bluetooth for example. The system communicates with a user terminal or home automation system as shown in FIG. 2, also preferably wirelessly.

Figure 7A:
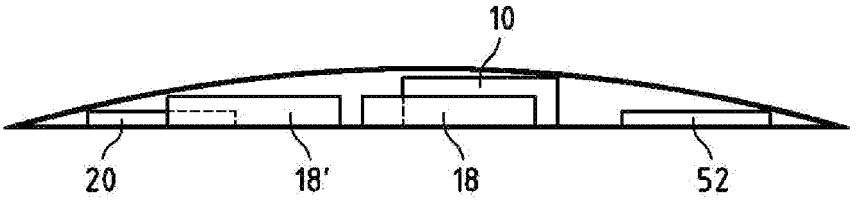
FIG. 7*a* shows a cross-section through a design of the retrofittable sensor unit in the form of an adhesively attachable foil.

FIG. 7*a* is a cross-sectional view through a version of the retrofittable sensor unit 1 embodied as an adhesively bonded foil. The foil preferably has a diameter of approximately 1 cm and a layer thickness of approximately 1 mm, and may be stuck for example to the inner side of a washing machine 44 door or an inner side of a dishwasher 42 door. In this context, the sensor unit 1 preferably includes printed electrical connections and has a communication unit 52 for preferably wireless communication between the sensor unit 1 and the dosing device 3 as well as with other sensors or user terminals 22. Besides the communication unit 52, a viscosity and turbidity sensor 18, 18' for capturing a condition of a washing solution and an energy supply system comprising rechargeable batteries or batteries 10 in the form of button cells are also provided. Finally, a monitoring unit 20 is also provided for controlling the retrofittable sensor unit.

Figure 7B:
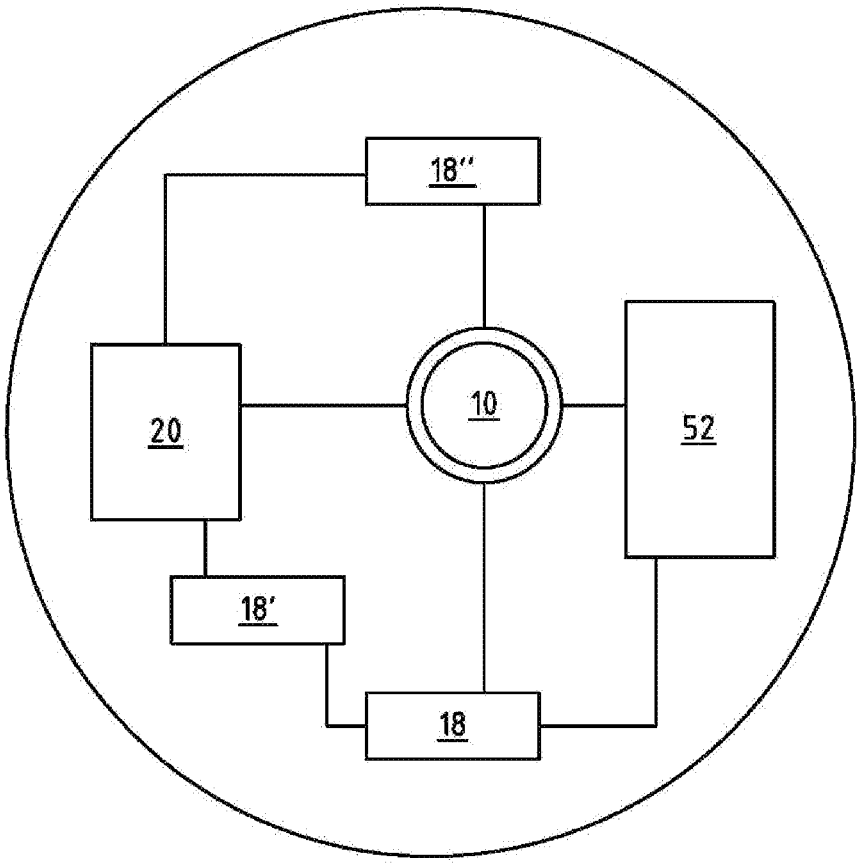

FIG. 7*b* shows a plan view of the retrofittable sensor unit 1 embodied as an adhesive foil as shown in FIG. 7*a*. Of course, the foil does not have to be circular as shown here, it may equally well be rectangular, trapezoidal, oval or any other such shape.

Figure 8:
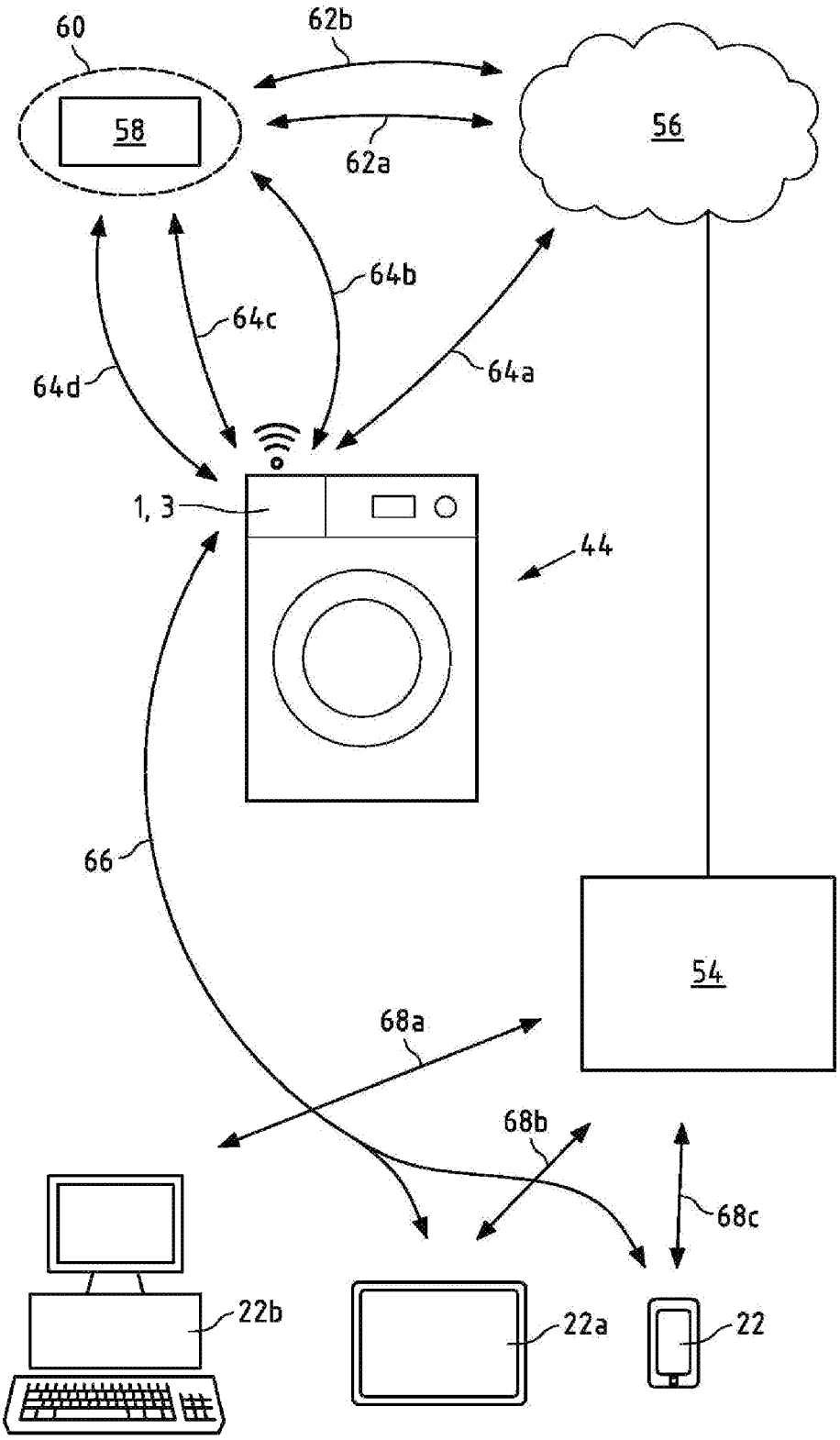
* and FIG. 8 shows a possible implementation form of communication paths between a retrofittable sensor unit in a cleaning machine and a cloud and user terminals.

FIG. 8 shows one possible form in which communication paths may be realised between an exemplary retrofittable sensor unit 1 arranged on a washing machine and a cloud 56 and user terminals 22 such as a smartphone 22, a tablet 22*a* or a PC 22*b*. Control is provided via the monitoring unit 20 of the retrofittable sensor unit 1, which communicates with user terminals 22 via the communication unit 6. In the design represented in FIG. 8, the retrofittable sensor unit 1 is arranged together with the mobile dosing device 3 in the detergent compartment 30 of the washing machine 44. Through the monitoring unit 20, the retrofittable sensor unit 1 may establish a link for example via a Bluetooth connection 64*b*, a WLAN connection 64*c* or an Ethernet connection 64*d* to a router 58 in a private or public network. Through the router 58, which may also be integrated in a home automation system 60, a connection may be established with a cloud 56, either by mobile communications using a wireless router over connection 62*b* for example with GSM, UMTS, 3G or LTE, or also with a cable link via Ethernet/glass fibre/ADSL or XDSL via connection 62*a* in the case of a DSL or VDSL router. The cloud 56 includes for example an internet service 54 and implements an internet site which can be opened from a user terminal 22, 22*a*, 22*b* following the corresponding authentication. Authentication of the user terminals 22, 22*a*, 22*b* with the internet service 54 may also take place over a cable link via Ethernet or wirelessly by WIFI or Bluetooth across paths 68*a-c*. Upon successful authentication, the desired information can be retrieved and controls of the machine 44 adopted. Alternatively, the cleaning machine 44 may be connected to the cloud 56 or a service 54 running therein directly by mobile communications using GSM, UMTS, 3G or LTE via link 64*a*. As an alternative to the cloud 56, the cleaning machine 44 may also communication with a user terminal and be controlled thereby with mobile communications directly via the link 66.

The designs of the present disclosure and the optional features and properties associated with each of said designs as explained in the preceding text are intended to be considered disclosed also in all combinations thereof with each other. In particular, the description of a feature included as part of one design—unless the contrary is explicitly indicated—is not to be construed as an indispensable or essential feature for the functioning of said design. The sequence of method steps set forth in the individual workflow diagrams in this specification is not mandatory, alternative sequences of the method steps are conceivable. The method steps may be implemented in various ways, for example an implementation in software (by program instructions), hardware or a combination of the two is conceivable for implementing the method steps.

Terms used in the patent claims such as "comprise", "include", "contain" and the like do not preclude further elements or steps. The formulation "at least partly" includes the notions of both "partly" and "completely". The formulation "and/or" is intended to be construed to mean that both the alternative and the combination are to be disclosed, i.e. "A and/or B" means "(A) or (B) or (A and B)". The use of the indefinite article does not preclude a plurality. A single device may perform the functions of several units and/or devices described in the patent claims. Reference signs appearing in the patent claims are not to be considered as limiting of the means and steps used.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A retrofittable sensor unit for controlling a dosing device of a cleaning machine, comprising:

an acquisition module having a viscosity sensor for determining a viscosity of a washing solution, a turbidity sensor to measure a turbidity of the washing solution, and a plurality of optical sensors positioned in a recess of the retrofittable sensor unit for capturing a plurality of images of articles for cleaning;

at least one monitoring unit configured to determine a material of the articles of cleaning and a current degree of the soiling of articles for cleaning in response to the plurality of images of the articles for cleaning and on the basis of the turbidity and the viscosity of the washing solution;

an autarchic energy conversion system mounted on a back of a washing drum of the cleaning machine such that the retrofittable sensor unit including the energy conversion system, rotates around an axis of rotation of the washing drum when the cleaning machine is in operation, for generation of an electrical energy in response to a rotational energy of the washing drum and wherein the electrical energy is coupled to the acquisition module; and at least one communication unit configured to transmit a dosing command to at least one dosing device depending on the current degree of soiling of the articles for cleaning, wherein the retrofittable sensor unit is arranged inside of the washing drum of the cleaning machine separately from the dosing device disposed within a detergent compartment of the cleaning machine.

2. The retrofittable sensor unit according to claim 1, wherein the acquisition module has at least one additional sensor for measuring at least one of a thermal variable and a calorific measurement variable.

3. The retrofittable sensor unit according to claim 1, wherein the acquisition module has at least one mini- or microcamera for capturing a condition of an article for cleaning.

4. The retrofittable sensor unit according to claim 1, wherein the communication unit is a wireless communication unit configured for wireless communication with other cleaning machines and/or for communication with portable user terminals.

5. The retrofittable sensor unit according to claim 1, wherein the energy conversion system includes a dynamo for generation of electrical energy in response to a rotational energy of the washing drum.

6. The retrofittable sensor unit according to claim 1, wherein the retrofittable sensor unit is partially spherical.

7. The retrofittable sensor unit according to claim 1, wherein the retrofittable sensor unit is at least in part embodied as a flat part.

8. The retrofittable sensor unit according to claim 1, wherein the monitoring unit of the retrofittable sensor unit is embodied as a self-learning unit.

9. The retrofittable sensor unit according to claim 2, wherein the at least one sensor is configured to measure pollen load, water hardness, color flush, pH value, or odor of the washing solution.

10. The retrofittable sensor unit according to claim 6, wherein the retrofittable sensor unit is hemispherical.

11. The retrofittable sensor unit according to claim 1, wherein the retrofittable sensor unit is at least partially embodied as a foil.

12. The retrofittable sensor unit according to claim 1, wherein the retrofittable sensor unit is arranged on a cleaning machine.

13. The retrofittable sensor unit according to claim 1, wherein the retrofittable sensor unit is arranged inside a cleaning machine.

* * * * *